US006303002B1

(12) United States Patent
Linhart et al.

(10) Patent No.: US 6,303,002 B1
(45) Date of Patent: Oct. 16, 2001

(54) METHOD FOR PRODUCING PAPER, PULPBOARD AND CARDBOARD

(75) Inventors: Friedrich Linhart, Heidelberg; Jaroslav Melzer; Hubert Meixner, both of Ludwigshafen, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/403,008

(22) PCT Filed: Apr. 2, 1998

(86) PCT No.: PCT/EP98/01947

§ 371 Date: Oct. 15, 1999

§ 102(e) Date: Oct. 15, 1999

(87) PCT Pub. No.: WO98/46828

PCT Pub. Date: Oct. 22, 1998

(30) Foreign Application Priority Data

Apr. 16, 1997 (DE) ..... 197 15 832

(51) Int. Cl.[7] ..... D21H 21/02

(52) U.S. Cl. ..... 162/199; 162/168.2; 162/168.3; 162/165; 162/166; 162/183; 162/164.3; 162/DIG. 4; 162/168.1

(58) Field of Search ..... 162/168.1–168.3, 162/169, 179, 164.1, 164.6, 164.5, 158, 199, 183, 170, DIG. 4, 166, 165, 167; 106/200.1–200.4, 14.31, 149, 155.22; 523/158, 416, 411, 337, 377; 524/514, 722

(56) References Cited

U.S. PATENT DOCUMENTS

| | | | | |
|---|---|---|---|---|
| 4,785,030 | * | 11/1988 | Noda et al. | 523/201 |
| 5,246,548 | | 9/1993 | Aston et al. . | |
| 5,292,403 | | 3/1994 | Dreisbach et al. . | |
| 5,300,194 | * | 4/1994 | Welkener et al. | 162/199 |
| 5,368,692 | * | 11/1994 | Derrick | 162/181.8 |
| 5,792,366 | * | 8/1998 | Coville | 210/734 |

FOREIGN PATENT DOCUMENTS

| | | |
|---|---|---|
| 2 162 567 | 7/1972 | (DE) . |
| 2 434 816 | 7/1974 | (DE) . |
| 195 15 273 A | 10/1996 | (DE) . |
| 0 335 575 A2 | 10/1989 | (EP) . |
| 0 359 590 A2 | 3/1990 | (EP) . |
| 0 411 400 A2 | 2/1991 | (EP) . |
| 0 649 941 A1 | 4/1995 | (EP) . |
| 6057685 A | 3/1994 | (JP) . |
| WO 96/34913 | 11/1996 | (WO) . |

OTHER PUBLICATIONS

Tappi Proceedings, Recycling Symposium 1994, "A New Approach to the Control of Stickies", John Ward,et al. (pp. 67–77).

* cited by examiner

*Primary Examiner*—Jose Fortuna
(74) *Attorney, Agent, or Firm*—Oblon, Spivak, McClelland, Maier & Neustadt, P.C.

(57) ABSTRACT

Paper, board and cardboard are produced from paper stocks which contain tacky impurities by the addition of surfactants and cationic polymers having a charge density of at least 1.5 meq/g (measured at pH 7) and a molar mass $M_w$ of the cationic polymers of at least 15,000 and drainage of the paper stocks with fixation of the tacky impurities in the paper produced.

5 Claims, No Drawings

METHOD FOR PRODUCING PAPER, PULPBOARD AND CARDBOARD

The invention relates to a process for the production of paper, board and cardboard from paper stocks which contain tacky impurities by the addition of surfactants and cationic polymers having a charge density of at least 1.5 meq/g (measured at pH 7) and drainage of the paper stocks with fixation of the tacky impurities in the paper produced.

The process described above is disclosed in TAPPI Proceedings, Recycling Symposium 1994, 67–77. According to this publication, the polymers must have a charge density of at least 1.5 meq and a low molar mass of about 10,000.

U.S. Pat. No. 5 292 403 discloses a process for inhibiting the deposition of organic impurities in papermaking, a mixture of a charged polymer and an oppositely charged surfactant being added to the paper stock and the latter being drained.

WO-A-96/34913 discloses a process for inhibiting the deposition of pitch, cationically modified guar derivatives and a nonionic polymer being used.

DE-A-195 152 273 discloses a process for controlling the settling of tacky impurities from paper stock suspensions. The settling of the stickies is controlled by adding to the paper stock suspension an effective amount of an alkoxylation product which is obtainable by reacting alkylene oxides with OH-containing $C_{10}$–$C_{22}$-carboxylic acids or derivatives thereof.

EP-A-0 649 941 likewise discloses a process for controlling the settling of tacky impurities from paper stock suspensions. In order to inhibit the deposition of pitch, polymers which contain N-vinylformamide units, alkyl-substituted N-vinylcarboxamide units or the vinylamine units formed therefrom by hydrolysis are used.

Owing to the reuse of fibers from waste paper for the production of paper, board and cardboard, tacky impurities, i.e. stickies and white pitch (binders originating from paper coats) enter the water circulation of paper machines and thus cause production problems. The tacky impurities are preferentially deposited in wires, felts, rolls and other moving parts of the paper machine. These impurities furthermore impair the efficiency of the retention aids usually used in papermaking. As shown by the abovementioned prior art, the tacky impurities can, for example, be fixed in the paper produced. If the procedure is carried out in the absence of fixing agents as process assistance, various problems may occur. For example, defects form in the paper web, generally in the form of thin parts or even holes, which can cause tears in the paper machine as well as in the printing press.

Sources of interfering substances for stickies in addition to resins and lignin components, which are dissolved out of the wood in fiber production by boiling and mechanical treatment, are mainly dispersions of natural colloidal systems, such as starch, casein and dextrin, and hotmelt adhesives. Specifically, these are resins, lignin residues, adhesives from the gluing of book spines, adhesives from pressure-sensitive adhesive labels and envelopes and white pitch, i.e. binders from coatings and printing inks. During working up of fibers from waste paper, the tacky impurities are in most cases removed only to an insufficient extent from the mixture. In order to reduce the tack of the undesired impurities, substances having a large surface area, eg. talc, chalk or bentonite, have long been added to the paper stock. This is intended to reduce the tack of the tacky impurities substantially, cf. TAPPI Press-1990, Vol. 2, pages 508 and 512. However, the disadvantage of the tacky impurities treated in this manner is their sensitivity to shearing and the limited retention of these particles in papermaking. Occasionally used dispersants, such as ligninsulfonates, naphthalenesulfonates, nonylphenols or alkoxylated fatty alcohols, prevent an agglomeration of stickies to form particles having a size troublesome for the papermaking process, but severe frothing of the paper stocks occasionally occurs when these process assistants are used.

It is an object of the present invention to provide an improved process for the production of paper, board and cardboard, starting from paper stocks which contain interfering substances dissolved in water and water-insoluble tacky impurities.

We have found that this object is achieved, according to the invention, by a process for the production of paper, board and cardboard from paper stocks which contain tacky impurities by the addition of nonionic surfactants and cationic polymers having a charge density of at least 1.5 meq/g (measured at pH 7) to paper stocks and drainage of the paper stocks with fixation of the tacky impurities in the paper produced, if

- polymers containing vinylamine units
- water-soluble, crosslinked polyamidoamines
- water-soluble, ethyleneimine-grafted, crosslinked polyamidoamines
- uncrosslinked polyamidoamines
- crosslinked polyethyleneimines
- polydiallyldimethylammononium halides and/or
- cationic polyacrylamides
- dicyandiamide/formaldehyde condensates are used as cationic polymers and if the molar mass $M_w$ of the cationic polymers is from 50,000 to 1 million.

The present invention furthermore relates to the use of from 0.005 to 0.5% by weight of nonionic surfactants and from 0.01 to 1.0% by weight of cationic polymers from the group consisting of

- polymers containing vinylamine units
- water-soluble, crosslinked polyamidoamines
- water-soluble, ethyleneimine-grafted, crosslinked polyamidoamines
- uncrosslinked polyamidoamines
- crosslinked polyethyleneimines
- polydiallyldimethylammononium halides and/or
- cationic polyacrylamides
- dicyandiamide/formaldehyde condensates having a molar mass $M_w$ of the cationic polymers of from 50,000 to 1 million and a charge density of at least 1.5 meq/g (measured at pH 7), the data in % by weight in each case being based on dry paper stock, in the production of paper, board and cardboard as an additive in the paper stock for the fixation of interfering substances which are dissolved in water, and of water-insoluble tacky impurities, in the paper produced.

Suitable fibers for the production of the pulps are all qualities conventionally used for this purpose, for example mechanical pulp, bleached and unbleached chemical pulp and paper stocks from all annual plants. Mechanical pulp includes, for example groundwood, thermomechanical pulp (TMP), chemothermomechanical pulp (CTMP), pressure groundwood, semichemical pulp, high-yield chemical pulp and refiner mechanical pulp (RMP). Examples of suitable chemical pulps are sulfate, sulfite and soda pulps. The unbleached chemical pulps, which are also referred to as unbleached craft carrier pulp, are preferably used. Suitable annual plants for the production of paper stocks are, for example, rice, wheat, sugarcane and kenaf. Waste paper alone or as a mixture with other fibers is also used for the production of the pulps. Waste paper includes coated waste which, owing to the content of binders for coatings and printing inks, gives rise to white pitch. The adhesives originating from pressure-sensitive adhesive labels and envelopes and adhesives from the gluing of book spines as well as hotmelts give rise to the formation of stickies.

The stated fibers can be used alone or as a mixture with one another. The pulps of the type described above contain varying amounts of water-soluble and water-insoluble interfering substances. The interfering substances can be quantitatively determined, for example, with the aid of the COD or with the aid of cationic demand. Cationic demand is understood as meaning that amount of a cationic polymer which is necessary to bring a defined amount of white water to the isoelectric point. Since the cationic demand depends to a very great extent on the composition of the respective cationic polymer used for the determination, a condensate obtained according to Example 3 of DE-C-2 434 816 is used for standardization, said condensate being obtainable by grafting of a polyamidoamine of adipic acid and diethylenetriamine with ethyleneimine and subsequently crosslinking with a polyethylene glycol dichlorohydrin ether. The pulps containing interfering substances have, for example, a COD of from 300 to 40,000, preferably from 1000 to 30,000 mg of oxygen per kg of the aqueous phase and a cationic demand of more than 50 mg of the stated cationic polymer per liter of white water.

The surfactants are nonionic. It is also possible to use mixtures of surfactants compatible with one another, which mixtures do not lead to precipitates, for example mixtures of anionic and nonionic surfactants or mixtures of nonionic and cationic surfactants. Suitable anionic surfactants are, for example, naphthalenesulfonic acid/formaldehyde condensates, ligninsulfonates, $C_1$- to $C_{22}$-alkylbenzenesulfonic acids, benzenesulfonic acid, fatty alcohol sulfates of fatty alcohols of 6 to 28 carbon atoms and alkanesulfonates, preferably having 6–22 carbon atoms in the alkyl group.

Suitable nonionic surfactants are, for example, the adducts of ethylene oxide and, if required, propylene oxide with fatty alcohols, fatty acids, fatty amines and $C_1$–$C_{18}$-alkyl phenols. Suitable fatty alcohols are derived, for example, from alcohols of 6 to 22 carbon atoms eg. n-octanol, isooctanol, dodecyl alcohol, lauryl alcohol, palmityl alcohol, stearyl alcohol, behenyl alcohol, tallow fatty alcohols and castor oil. Fatty acids, preferably derived from fatty acids of 6 to 20 carbon atoms, for example lauric acid, stearic acid, palmitic acid, behenic acid, tallow fatty acid and oleic acid, are suitable as further components for the preparation of surfactants. Other starting materials of the preparation of surfactants are fatty amines, which have, for example, 6 to 22 carbon atoms in the molecule, eg. palmitylamine, tallow fatty amine and oleylamine. Other suitable starting materials for the preparation of surfactants are $C_1$–$C_{18}$-alkylphenols such as nonylphenol or dodecylphenol. The abovementioned fatty alcohols, fatty acids, fatty amines and alkylphenols are reacted with ethylene oxide and, if required, with propylene oxide for the preparation of surfactants, for example from 2 to 50 mol of ethylene oxide and, if required, propylene oxide being subjected to an addition reaction with 1 mol of the hydrophobic component. For example, 1 mol of the suitable fatty alcohols, fatty acids, fatty amines or alkylphenols is preferably reacted with from 1 to 50 mol of ethylene oxide and, if required, from 1 to 30 mol of propylene oxide. For special applications, it is also possible to use block copolymers, which are obtainable by reacting the abovementioned hydrophobic compounds first with ethylene oxide, then with propylene oxide and then with ethylene oxide. It is also possible to use block copolymers which contain blocks of propylene oxide/ethylene oxide/propylene oxide bonded to the abovementioned hydrophobic components.

Preferably used surfactants are the adducts of from 1 to 40 mol of ethylene oxide and, if required, from 1 to 20 mol of propylene oxide with 1 mol of a $C_{10}$–$C_{22}$-fatty alcohol or of a fatty alcohol mixture and naphthalenesulfonic acid/formaldehyde condensates and mixtures of naphthalenesulfonic acid/formaldehyde condensates and ethoxylated and, if required, propoxylated fatty alcohols of 10 to 22 carbon atoms.

The surfactants are used, for example, in amounts of from 0.005 to 0.5, preferably from 0.01 to 0.2% by weight, based on dry paper stock.

The cationic polymers may be derived from synthetic and natural cationic polymers. Suitable natural polymers are, for example, cationic polysaccharides, cationic starch, cationic amylose and derivatives thereof, cationic amylopectin and derivatives thereof and guar derivatives.

The synthetic cationic polymers include, for example, polyethyleneimines. They are prepared, for example, by polymerizing ethyleneimine in aqueous solution in the presence of acid-eliminating compounds, acids or Lewis acids. Polyethyleneimines are commercially available; they have, for example, molar masses of from 200 to 2,000,000, preferably from 200 to 1,000,000. Polyethyleneimines having molar masses of from 500 to 800,000 are particularly preferably used in the novel process. A further class of synthetic cationic compounds comprises polymers containing vinylamine units. They are prepared, for example, starting from open-chain N-vinylcarboxamides of the formula (I)

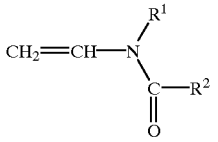

where $R^1$ and $R^2$ may be identical or different and are each hydrogen or $C_1$–$C_6$-alkyl. Suitable monomers are, for example, N-vinylformamide ($R^1$=$R^2$=H in formula I), N-vinyl-N-methylformamide, N-vinylacetamide, N-vinyl-N-methylacetamide, N-vinyl-N-ethylacetamide, N-vinyl-N-methylpropionamide and N-vinylpropionamide. For the preparation of polymers, the stated monomers can be polymerized either alone, as a mixture with one another or together with other monoethylenically unsaturated monomers. Preferably, homo- or copolymers of N-vinylformamide are used as starting materials.

Suitable monoethylenically unsaturated monomers which are copolymerized with the N-vinylcarboxamides are all compounds copolymerizable therewith. Examples of these are vinyl esters of saturated carboxylic acids of 1 to 6 carbon atoms, such as vinyl formate, vinyl acetate, vinyl propionate and vinyl butyrate.

Further suitable comonomers are ethylenically unsaturated $C_3$–$C_6$-carboxylic acids, for example acrylic acid, methacrylic acid, maleic acid, crotonic acid, itaconic acid and vinyl acetic acid, and their alkali and alkali earth metal salts, esters, amides and nitriles of the stated carboxylic acids, for example methyl acrylate, methyl methacrylate, ethyl acrylate and ethyl methacrylate. Further suitable carboxylic esters are derived from glycols or polyalkylene glycols, only one OH group being esterified in each case, eg. hydroxyethyl acrylate, hydroxyethyl methacrylate, hydroxypropyl acrylate, hydroxybutyl acrylate, hydroxypropyl methacrylate, hydroxybutyl methacrylate and acrylic monoesters of polyalkylene glycols having a molar mass of from 500 to 10,000. Further suitable comonomers are esters of ethylenically unsaturated carboxylic acids with amino alcohols, for example dimethylaminoethyl acrylate, dimethylaminoethyl methacrylate, diethylaminoethyl acrylate, diethylaminoethyl methacrylate, dimethylaminopropyl acrylate, dimethylaminopropyl methacrylate, diethylaminopropyl acrylate, dimethylaminobutyl acrylate and diethylaminobutyl acrylate. The basic acrylates can be used in the form of free bases, of the salts with mineral acids, such as hydrochloric acid and sulfuric acid or nitric acid, of the salts with organic acids, such as formic acid, acetic acid or propionic acid, or of the sulfonic acids or in quaternized form. Suitable quaternizing agents are, for example, dimethyl sulfate, diethyl sulfate, methyl chloride, ethyl chloride or benzyl chloride.

Further suitable comonomers are amides of ethylenically unsaturated carboxylic acids, such as acrylamide, methacrylamide and N-alkylmonoamides and N-alkyldiamides of monoethylenically unsaturated carboxylic acids having alkyl radicals of from 1 to 6 carbon atoms, eg. N-methylacrylamide, N,N-dimethylacrylamide, N-methylmethacrylamide, N-ethylacrylamide, N-propylacrylamide and tert-butylacrylamide, and basic (meth)acrylamides, eg. dimethylaminoethylacrylamide, dimethylaminoethylmethacrylamide, diethylaminoethylacrylamide, diethylaminoethylmethacrylamide, dimethylaminopropylacrylamide, diethylaminopropylacrylamide, dimethylaminopropylmethacrylamide and diethylaminopropylmethacrylamide.

Other suitable comonomers are N-vinylpyrrolidone, N-vinylcaprolactam, acrylonitrile, methacrylonitrile, N-vinylimidazole and substituted N-vinylimidazoles, eg. N-vinyl-2-methylimidazole, N-vinyl-4-methylimidazole, N-vinyl-5-methylimidazole, N-vinyl-2-ethylimidazole and N-vinylimidazolines such as N-vinylimidazoline, N-vinyl-2-methylimidazoline and N-vinyl-2-ethylimidazoline. N-Vinylimidazoles and N-vinylimidazolines are used not only in the form of the free bases but also in a form neutralized with mineral acids or organic acids or in quaternized form, quaternization preferably being effected with dimethyl sulfate, diethyl sulfate, methyl chloride or benzyl chloride. Diallyldialkylammonium halides, eg. diallyldimethylammonium chloride, are also suitable.

Other suitable comonomers are sulfo-containing monomers, for example vinylsulfonic acid, allylsulfonic acid, methallylsulfonic acid, styrenesulfonic acid, the alkali metal and ammonium salts of these acids and 3-sulfopropyl acrylate.

The copolymers contain, for example, from 99 to 1 mol % of N-vinylcarboxamides of the formula I and from 1 to 99 mol % of other monomethylenically unsaturated monomers, copolymerizable therewith in polymerizble form.

In order to prepare polymers containing vinylamine units, it is preferable to start from homopolymers of N-vinylformamides or from copolymers which are obtainable by copolymerization of from N-vinylformamide with vinyl formate, vinyl acetate, vinyl propionate, acrylonitrile or N-vinylpyrrolidone and subsequent hydrolysis of the homo- or copolymers with formation of vinylamine units from the N-vinylformamide units incorporated as polymerized units, the degree of hydrolysis being, for example, from 5 to 100 mol %.

The hydrolysis of the polymers described above is carried out by the action of acids, bases or enzymes by known methods. Elimination of the groups

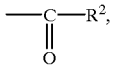

(II)

where $R^2$ has the meaning stated for $R^2$ in the formula I, from the polymerized monomers of the abovementioned formula I gives polymers which contain vinylamine units of the formula

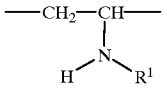

(III)

where $R^1$ has the meaning stated in formula I.

The homopolymers of the N-vinylcarboxamides of the formula I and their copolymers may be hydrolyzed to an extent of from 5 to 100, preferably from 10 to 100, mol %. In most cases, the degree of hydrolysis of the homo- and copolymers is from 20 to 90 mol %. The degree of hydrolysis of the homopolymers is equivalent to the content of vinylamine units in the polymers. In the case of copolymers which contain, for example, polymerized vinyl ester, hydrolysis of the ester groups with formation of vinyl alcohol units may occur in addition to the hydrolysis of the N-vinylformamide units. This is the case in particular when the hydrolysis of the copolymers is carried out in the presence of sodium hydroxide solution. Polymerized acrylonitrile is likewise chemically modified in the hydrolysis. Here, for example, amido groups or carboxyl groups are formed The polymers containing vinylamine units can, if required, contain up to 20 mol % of amidine units, which are formed, for example, by intramolecular reaction of an amino group with a neighboring amido group, for example of polymerized N-vinylformamide.

Further suitable cationic polymers are crosslinked polyethyleneimines, which are obtainable, for example, by reacting polyethyleneimines with crosslinking agents, such as ethylene dichloride, epichlorohydrin or bis(chlorohydrin) ethers of polyalkylene oxides having 2–100 ethylene oxide units.

Other suitable cationic polymers are water-soluble, ethyleneimine-grafted, crosslinked polyamidoamines. Condensates of this type are obtainable, for example, according to DE-B-2 434 816, by grafting polyamidoamines with ethyleneimine and crosslinking the resulting ethyleneimine-grafted polyamidoamines. Preferred crosslinking agents are α,ω-bis(chlorohydrin) ethers of polyalkylene oxides having from 2 to 100 alkylene oxide units. The polyalkylene oxides are preferably derived from ethylene oxide and/or propylene oxide. They may be formed from block copolymers of ethylene oxide and propylene oxide. Products of this type are commercially available. Dicyandiamide/formaldehyde resins, condensates of dimethylamine and epichlorohydrin, condensates of dimethylamine and dichloroalkanes, such as dichloroethane or dichloropropane, and condensates of dichloroethane and ammonia are also suitable. Reaction products of this type are disclosed, for example, in EP-A-0 411 400 and DE-A-2 162 567.

Further suitable cationic synthetic polymers are obtainable by is crosslinking polyamidoamines with epichlorohydrin or other bifunctional compounds. The crosslinking is effected in an aqueous medium and is terminated while the resulting condensates are still water-soluble.

A further group of cationic synthetic polymers comprises cationic polyacrylamides, which are obtainable, for example, by polymerizing acrylamide or methacrylamide with cationic monomers such as esters or acrylic acid or methacrylic acid and amino alcohols, eg. dimethylaminoethyl acrylate, dimethylaminoethyl methacrylate, diethylaminoethyl acrylate, diethylaminoethyl methacrylate, dimethylaminopropyl acrylate and dimethylaminopropyl methacrylate. The stated basic acrylates can be used in the form of the free bases, in the form of the salts with organic or inorganic acids or in quaternized form in the copolymerization. From this group of monomers, dimethylaminoethyl acrylate in the form of the methochloride is preferably used. Further suitable basic comonomers for acrylamide and methacrylamide are, for example, acrylamidopropyltrimethylammonium salts and diallyldimethylammonium halides. However, the abovementioned basic comonomers can also be processed to give homopolymers and can be used as cationic synthetic polymers in the novel process.

Preferably used cationic polymers are polymers containing vinylamine units water-soluble, crosslinked polyamidoamines water-soluble, ethyleneimine-grafted, crosslinked polyamidoamines uncrosslinked polyamidoamines crosslinked polyethyleneimines polydiallyldimethylammononium halides and/or cationic polyacrylamides dicyandiamide/formaldehyde condensates.

The molar mass $M_w$ of the cationic polymers is from 50,000 to 1,000,000. The molar mass $M_w$ of the cationic polymers is determined by light scattering. The cationic polymers have a charge density of at least 1.5, preferably from 4 to 15, meq/g (measured at pH 7). The cationic polymers are used in amounts of from 0.01 to 1.0, particularly from 0.02 to 0.5, % by weight, based on dry paper stock.

In order to eliminate the interfering substances dissolved in water and the water-insoluble tacky impurities (eg. stickies and white pitch) as substantially as possible from the water circulation of paper machines, first a surfactant and then a cationic polymer, as fixing agent, are added to the stock suspension. However, surfactant and fixing agent can also be added simultaneously and separately from one another or in the form of a mixture. The ratio of fixing agent to retention aid depends on the paper stock used in each case and is, for example, from 1:2 to 5:1.

In a preferred embodiment of the novel process, a retention-aid is used in addition to surfactants and cationic polymers. This results in even more substantial removal of the tacky impurities from the paper stock. Surprisingly, the finely divided tacky impurities are not coagulated but are retained in finely divided form on the paper stock. The improved fixation of stickies, white pitch and other tacky impurities in the paper can be quantitatively determined, for example, by extraction of the sheets formed from pulps containing interfering substances, or of the fiber material filtered off, with the use of conventional organic extracting agents, such as ethyl acetate, methylene chloride or hydrocarbons.

Suitable retention aids are compounds which can be prepared from the same monomers as those employed for the cationic synthetic polymers to be used as fixing agents. However, the retention aids have a higher molecular weight than the fixing agents. For example, the molar mass of the retention aids is more than 2,000,000. Suitable retention aids of this type are usually used in the paper industry. They are, for example, cationic polyacrylamides, eg. copolymers of acrylamide and dimethylaminoethyl acrylate methochloride or partially hydrolyzed polyvinylformamides containing from 5 to 50 mol % of vinylamine units. Microparticle systems which are described in EP-A 0 335 575 are also suitable, a high molecular weight cationic synthetic polymer being added to the paper stock, the resulting macroflocs being broken up by subjecting the paper stock to shearing and bentonite then being added.

A particularly advantageous procedure is one in which adducts of ethylene oxide and, if required, propylene oxide with fatty alcohols of 10 to 22 carbon atoms or with $C_1$–$C_{18}$-alkylphenols are added as surfactants and at least 20% hydrolyzed polyvinylformamides having a molar mass of from 50,000 to 1,000,000 as synthetic cationic polymeric fixing agents and at least from 5 to 50% hydrolyzed poly-N-vinylformamides having a molar mass of more than 3,000,000 are then metered in as retention aids.

In the examples which follow, parts and percentages are by weight, unless stated otherwise. The chemical oxygen demand (COD) was determined according to DIN 38409. The molar masses Mv were measured with the aid of light scattering.

EXAMPLE

The following substances were used as cationic polymers:

Polymer A: polydiallyldimethylammonium chloride having a charge density of 8 meq/g and a molar mass $M_w$ of 200,000 D.

Polymer B: dicyandiamide/formaldehyde resin having a charge density of 4 meq/g (measured at pH 7) and a molar mass $M_w$ of 500,000.

Polymer C: modified polyethyleneimine having a charge density of 11 meq/g (determined at pH 7) and a molar mass of 35 700,000.

The following surfactants were used:

Surfactant 1: Adduct of 7 mol of ethylene oxide with 1 mol of nonylphenol

Surfactant 2: Adduct of 6 mol of ethylene oxide and 4 mol of propylene oxide with 1 mol of a $C_{13}/C_{15}$-alcohol

Examples 1 to 6

A pulp having a consistency of 2.1 g/l and a freeness of 51° SR (Schopper-Riegler) is prepared from a thermomechanical pulp (100% TMP). The pH of the pulp is 7.0. The amounts of surfactant which are stated in the table are then added, one of the polymers A to C stated in the table is then added as a fixing agent to the mixture and sheets are produced in a Rapid-Köthen sheet former using a retention and drainage aid based on a commercial, crosslinked polyamidoamine modified with ethyleneimine (Polymin®SK) and is then dried.

8 g of the dried sheets are then extracted in a Soxhlet apparatus for 4 hours with 70 ml of dichloroethane. After the extraction, the tacky impurities which were originally present in the pulp and had been fixed in the paper are isolated from the extracting agent. The amount of tacky impurities is stated in the table as a percentage by weight of interfering substance in the paper.

Comparative Examples 1 to 6

For comparison, sheets are produced as described above under the Examples, the additives stated in Table 1 (surfactant or polymer metered) and then the retention aid being added to the paper stock. The procedure is continued as described in Examples 1 to 6 and the content of interfering substance in the paper is determined. The results are shown in the table.

TABLE

| | Comparative Examples | | | | | | Examples | | | | | |
|---|---|---|---|---|---|---|---|---|---|---|---|---|
| | 1 | 2 | 3 | 4 | 5 | 6 | 1 | 2 | 3 | 4 | 5 | 6 |
| Surfactant 1 | — | 0.02 | — | — | — | — | 0.1 | 0.1 | 0.1 | 0.1 | 0.2 | 0.2 |
| Surfactant 2 | — | — | 0.2 | — | — | — | — | — | — | — | — | 0.2 |
| Polymer A | — | — | — | 0.2 | — | — | 0.2 | 0.4 | — | — | — | — |
| Polymer B | — | — | — | — | 0.2 | — | — | — | — | — | 0.2 | 0.2 |
| Polymer C | — | — | — | — | — | 0.2 | — | — | 0.2 | 0.4 | — | — |
| % of interfering substance in the paper | 0.015 | 0.03 | 0.07 | 0.13 | 0.06 | 0.17 | 0.56 | 0.51 | 0.64 | 0.66 | 0.199 | 0.17 |

We claim:

1. A process for the production of paper, board and cardboard from paper stocks which contain tacky impurities, the process comprising adding nonionic surfactants and cationic polymers having a charge density of at least 1.5 meq/g (measured at pH 7) to paper stocks;

draining the paper stocks; and producing a paper from the paper stock with the tacky impurities fixed in the paper, wherein the cationic polymers are selected from the group consisting of polymers containing vinylamine units; water-soluble, crosslinked polyamidoamines; water-soluble, ethyleneimime-graft, crosslinked polyamidoamines, uncrosslinked polyamidoamines; crosslinked polyethyleneimines; polydiallyldimethylammononium halides; cationic polyacrylamides; and dicyandiamide/formaldehyde condensates;

the molar mass MW of the cationic polymers is from 50,000 to 1 million; and the surfactants are added in an amount of from 0.10 to 0.5% by weight, based on dry paper stock.

2. The process as claimed in claim 1, wherein the cationic polymers are added in an amount of from 0.01 to 1.0% by weight, based on dry paper stock.

3. The process as claimed in claim 1, wherein the cationic polymers are added in an amount of from 0.02 to 0.5% by weight, based on dry paper stock.

4. The process as claimed in claim 1, wherein the surfactants comprise adducts of at least one of ethylene oxide and propylene oxide with fatty alcohols of 6 to 22 carbon atoms or with $C_1$–$C_{18}$-alkylphenols.

5. The process as claimed in claim 1, wherein the surfactants are added in an amount of from 0.10 to 0.2% by weight, based on dry paper stock.

* * * * *